US011385558B2

(12) United States Patent
Chimoto et al.

(10) Patent No.: US 11,385,558 B2
(45) Date of Patent: Jul. 12, 2022

(54) TONER

(71) Applicant: CANON KABUSHIKI KAISHA, Tokyo (JP)

(72) Inventors: Yuya Chimoto, Funabashi (JP); Kouichirou Ochi, Chiba (JP); Tomoyo Miyakai, Tokyo (JP); Takashi Hirasa, Moriya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/902,365

(22) Filed: Jun. 16, 2020

(65) Prior Publication Data

US 2020/0310273 A1 Oct. 1, 2020

Related U.S. Application Data

(63) Continuation of application No. PCT/JP2018/046451, filed on Dec. 18, 2018.

(30) Foreign Application Priority Data

Dec. 20, 2017 (JP) ..... JP2017-243768
Nov. 5, 2018 (JP) ..... JP2018-208435

(51) Int. Cl.
*G03G 9/097* (2006.01)
*G03G 9/09* (2006.01)
*G03G 9/087* (2006.01)

(52) U.S. Cl.
CPC ..... *G03G 9/09791* (2013.01); *G03G 9/08755* (2013.01); *G03G 9/0902* (2013.01)

(58) Field of Classification Search
CPC ..... G03G 9/08755; G03G 9/08782; G03G 9/0975; G03G 9/09791
See application file for complete search history.

(56) References Cited

U.S. PATENT DOCUMENTS 7,833,687 B2 11/2010 Kato et al.
8,697,327 B2 4/2014 Shibata et al.
9,057,970 B2 6/2015 Ida et al.
9,348,247 B2 5/2016 Ida et al.
9,540,483 B2 1/2017 Ida et al.
9,696,644 B2 7/2017 Ida et al.
9,891,545 B2 2/2018 Anno et al.
9,897,934 B2 2/2018 Tamura et al.
10,012,920 B2 7/2018 Shibata et al.
10,078,281 B2 9/2018 Ida et al.
10,088,765 B2 10/2018 Miyakai et al.
10,095,141 B2 10/2018 Urabe
10,095,142 B2 10/2018 Hirai et al.
10,203,619 B2 2/2019 Yamashita et al.
10,228,629 B2 3/2019 Tamura et al.
10,353,312 B2 7/2019 Kamae et al.
10,451,990 B2 10/2019 Kamae et al.
10,514,624 B2 12/2019 Tamura et al.
2010/0068646 A1* 3/2010 Yamamoto ..... G03G 9/0821 430/124.1
2010/0261113 A1* 10/2010 Aruga ..... G03G 9/0804 430/105
2013/0108955 A1 5/2013 Shibata et al.
2013/0202998 A1 8/2013 Higashi et al.
2015/0099227 A1 4/2015 Ida et al.
2016/0054670 A1* 2/2016 Urabe ..... G03G 15/0865 430/105
2017/0090320 A1 3/2017 Taguchi et al.
2018/0348658 A1 12/2018 Tsuchida et al.
2020/0272068 A1 8/2020 Ochi et al.
2020/0301301 A1 9/2020 Chimoto et al.

FOREIGN PATENT DOCUMENTS

JP 2014-157188 8/2014
JP 2016-045323 4/2016
JP 2017-062414 3/2017
JP 2017-156576 9/2017
JP 2017-181647 10/2017

OTHER PUBLICATIONS

U.S. Appl. No. 16/923,518, Kouichirou Ochi, filed Jul. 8, 2020.
U.S. Appl. No. 17/012,718, Naohiko Tsuchida, filed Sep. 4, 2020.
U.S. Appl. No. 17/020,223, Akifumi Matsubara, filed Sep. 14, 2020.
U.S. Appl. No. 17/020,253, Yuzo Tokunaga, filed Sep. 14, 2020.

* cited by examiner

*Primary Examiner* — Peter L Vajda
(74) *Attorney, Agent, or Firm* — Venable LLP

(57) ABSTRACT

A toner has a toner particle containing a resin having an acid group, an aluminum pigment, and a fatty acid metal salt, wherein an acid value of the resin having an acid group is in a range of from 5 mg KOH/g to 25 mg KOH/g, and an amount of the resin having the acid group is 50% by mass or more; an amount of the aluminum pigment is in a range of from 10% by mass to 40% by mass; the fatty acid metal salt is represented by formula $(R—COO)_pM(OH)_q$; and an amount thereof is in a range of from 1 part by mass to 10 parts by mass based on 100 parts by mass of the aluminum pigment.

15 Claims, No Drawings

TONER

CROSS-REFERENCE TO RELATED APPLICATIONS

This application is a Continuation of International Patent Application No. PCT/JP2018/046451, filed Dec. 18, 2018, which claims the benefits of Japanese Patent Application No. 2017-243768, filed Dec. 20, 2017, and Japanese Patent Application No. 2018-208435, filed Nov. 5, 2018, all of which are hereby incorporated by reference herein in their entirety.

BACKGROUND OF THE INVENTION

Field of the Invention

The present invention relates to a toner for use in an electrophotographic image forming method.

Background Art

In recent years, with the development of image forming apparatuses such as copiers and printers, there has been a need for toners capable of meeting the growing demand for higher speed, higher image quality, longer life, and energy savings. To achieve higher image quality, special color toners that cover colors that cannot be expressed by the conventional YMCK have been developed. One example is a toner emitting a metallic gloss color (metallic color). To emit a metallic gloss color, for example, a toner using a metallic aluminum pigment has been developed (for example, PTL 1).

CITATION LIST

Patent Literature

PTL 1 Japanese Patent Laid-Open No. 2014-157188

A means for enhancing the metallic gloss color involves including a large amount of an aluminum pigment in the toner. However, it was found that as a result, the folding resistance of the fixed image was reduced due to the decrease in the amount of resin component.

To solve this problem, it is possible to use a high molecular weight resin having a large amount of a crosslinking component, thereby improving the folding resistance. However, it was found that since the toner was unlikely to be crushed, the aluminum pigment was hardly oriented, and the metallic gloss of the image was reduced.

Regarding this problem, it is an object of the present invention to provide a toner which is excellent in metallic gloss and folding resistance of an image.

SUMMARY OF THE INVENTION

As a result of intensive studies, the present inventors have found that the above-mentioned problem can be solved by containing a resin having a specific acid value, an aluminum pigment, and a fatty acid metal salt in a toner particle.

The fatty acid metal salt is composed of a carboxylic acid metal salt segment and a long-chain alkyl segment. It is conceivable that since the fatty acid metal salt is present in the toner particle, the carboxylic acid metal salt segment of the fatty acid metal salt interacts with an acid group (for example, a carboxy group) of the resin having an acid group and a hydroxyl group derived from alumina present on the surface of the aluminum pigment, thereby enhancing the interaction between the resin having an acid group and the aluminum pigment.

Further, the presence of a flexible long-chain alkyl segment presumably alleviates stress when such is applied. It is considered that the above-mentioned interaction is maintained even after the fixing step in the electrophotographic process, and as a result, the folding resistance of the image is improved.

That is, an aspect of the present invention resides in a toner having a toner particle containing a resin having an acid group, an aluminum pigment, and a fatty acid metal salt, wherein an acid value of the resin having the acid group is in a range of from 5 mg KOH/g to 25 mg KOH/g, and an amount of the resin having the acid group in the toner particle is 50% by mass or more;

an amount of the aluminum pigment in the toner particle is in a range of from 10% by mass to 40% by mass;

the fatty acid metal salt is represented by following formula (1); and an amount of the fatty acid metal salt in the toner particle is in a range of from 1 part by mass to 10 parts by mass based on 100 parts by mass of the aluminum pigment.

$$(R—COO)_p \quad M \quad (OH)_q \tag{1}$$

In formula (1), R is each independently a linear or branched alkyl group having a carbon number of from 8 to 30, or a linear or branched hydroxyalkyl group having a carbon number of from 8 to 30, M is Al, Zn, Mg, Ca, Sr, K or Na, p represents an integer of from 1 to 3, and q represents an integer of from 0 to 2.

Further features of the present invention will become apparent from the following description of exemplary embodiments.

DESCRIPTION OF THE EMBODIMENTS

The expression "from XX to YY" or "XX to YY" representing the numerical range means a numerical range including a lower limit and an upper limit which are endpoints unless otherwise specified.

The toner of the present invention includes a resin having an acid group, an aluminum pigment, and a fatty acid metal salt in a toner particle.

The resin having an acid group used in the present invention means a resin having an acid group such as a carboxyl group, a sulfo group or the like at a terminal or a side chain of a molecular chain. Specific suitable examples include acrylic resins, methacrylic resins, styrene-acrylic copolymers, styrene-methacrylic copolymers, polyester resins, and the like. Among these, from the viewpoint of easy realization of the present embodiment, it is preferable to use a polyester resin.

In the present invention, the amount of the resin having an acid group in the toner particle needs to be 50% by mass or more. The resin having an acid group comprises a single resin or a plurality of resins. When the amount thereof is in the above range, it is considered that the folding property is improved because the strength of the image is improved.

The amount of the resin having an acid group in the toner particle is preferably 60% by mass or more. The upper limit is not particularly limited, but is preferably 85% by mass or less, and more preferably 80% by mass or less.

From the viewpoint of folding resistance, the acid value of the resin having an acid group is required to be in the range of from 5 mg KOH/g to 25 mg KOH/g, and is preferably in the range of from 7 mg KOH/g to 20 mg KOH/g. It is considered that within the above-mentioned range, the below-described fatty acid metal salt interacts with the resin having an acid group and the below-described aluminum pigment in a well-balanced manner, and the folding resistance is improved.

The acid value is the number of milligrams of potassium hydroxide required to neutralize acid components such as free fatty acids and resin acids contained in 1 g of a sample. The measurement is performed according to JIS K 0070.

The polyester resin preferably contains a monomer unit derived from an alcohol component and a monomer unit derived from an acid component. The monomer unit refers to a form after a monomer substance in a polymer has reacted. The following compounds may be mentioned as monomers for forming the polyester resin.

Examples of the alcohol component include the following dihydric alcohols.

Ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenols represented by the following formula (I) and derivatives thereof, and diols represented by the following formula (II).

Trihydric or higher polyhydric alcohols such as 1,2,3-propanetriol, trimethylolpropane, hexanetriol, and pentaerythritol may also be used as the alcohol component.

(I)

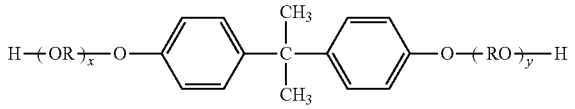

(In the formula, R represents an ethylene group or a propylene group, X and Y are each an integer of 0 or more, and the average value of X+Y is from 0 to 10.)

(II)

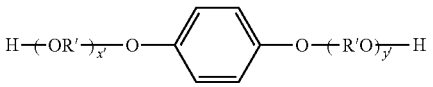

In the formula, R' represents:

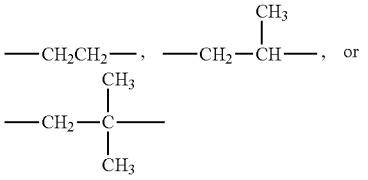

x' and y' are each an integer of 0 or more, and the average value of x'+y' is from 0 to 10.

Examples of the acid component include the following divalent carboxylic acids.

Benzenedicarboxylic acids or anhydrides thereof such as phthalic acid, terephthalic acid, isophthalic acid, and phthalic anhydride; alkyl dicarboxylic acids such as succinic acid, adipic acid, sebacic acid, and azelaic acid or anhydrides thereof; succinic acid or an anhydride thereof substituted with an alkyl group having from 6 to 18 carbon atoms or an alkenyl group having from 6 to 18 carbon atoms; and unsaturated dicarboxylic acids such as fumaric acid, maleic acid, citraconic acid, and itaconic acid, or anhydrides thereof.

It is also preferable to use a trivalent or higher polycarboxylic acid for the acid component. Examples thereof include 1,2,4-benzenetricarboxylic acid (trimellitic acid), 1,2,4-cyclohexanetricarboxylic acid, 1,2,4-naphthalenetricarboxylic acid, pyromellitic acid and acid anhydrides or lower alkyl esters thereof.

Among these, aromatic compounds having high stability against environmental fluctuations are preferable, and examples thereof include 1,2,4-benzenetricarboxylic acid and anhydrides thereof.

As the alcohol component, a bisphenol represented by the formula (I) is preferable, and alkylene (ethylene or propylene) oxide adducts of bisphenol A, such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxyethylene(2.2)-2,2-bis(4-hydroxyphenyl)propane, polyoxypropylene(2.0)-polyoxyethylene (2.0)-2,2-bis(4-hydroxyphenyl)propane, and polyoxypropylene(6)-2,2-bis(4-hydroxyphenyl)propane are more preferable. That is, the polyester resin preferably contains a monomer unit derived from an alkylene oxide adduct of bisphenol A. More preferred is a propylene oxide adduct of bisphenol A.

From the viewpoint of folding resistance, the content ratio of the monomer unit derived from the propylene oxide adduct of bisphenol A among the monomer units derived from the alcohol component contained in the polyester resin is preferably in the range of from 70 mol % to 100 mol %, and more preferably in the range of from 80 mol % to 100 mol %.

The ratio of the unit derived from the propylene oxide adduct of bisphenol A can be measured by a known method, for example, by NMR.

The weight average molecular weight Mw of the polyester resin is preferably in the range of from 50,000 to 500,000, more preferably in the range of from 80,000 to 300,000, and even more preferably in the range of from 100,000 to 250,000.

From the viewpoint of metallic gloss and folding resistance, the ratio Mw/Mn of the weight average molecular weight Mw to the number average molecular weight Mn of the polyester resin is preferably 10 or more, and more preferably 20 or more. Meanwhile, the upper limit is not particularly limited, but is preferably 80 or less, and more preferably 50 or less.

From the viewpoint of metallic gloss and folding resistance, the content ratio of the component having a molecular weight in the range of from 100 to 5,000 as measured by GPC of the tetrahydrofuran-soluble fraction of the polyester resin is preferably in the range of from 10% by mass to 50% by mass, and more preferably in the range of from 20% by mass to 40% by mass based on the total mass of the tetrahydrofuran-soluble fraction of the polyester resin. The content ratio of the component having a molecular weight in the range of from 100 to 5,000 can be controlled by, for example, adjusting the polymerization conditions of the polyester resin, mixing a plurality of resins, or the like.

In the present invention, other polymers may be used in combination with the resin having an acid group to the extent that the effects of the present invention are not impaired. Specifically, homopolymers of styrene and substituted products thereof such as polystyrene, poly-p-chlorostyrene, polyvinyltoluene, and the like; styrene copolymers such as styrene-p-chlorostyrene copolymer, styrene-vinyltoluene copolymer, styrene-vinylnaphthalene copolymer, styrene-acrylate copolymers, styrene-methacrylate copolymers, and the like; polyvinyl chloride, phenolic resins, phenolic resins modified with natural resins, maleic resins modified with natural resins, acrylic resins, methacrylic resins, polyvinyl acetate, silicone resins, polyurethane resins, polyamide resins, furan resins, epoxy resins, xylene resins, polyethylene resin, polypropylene resin, and the like.

In the present invention, the aluminum pigment is a brilliant pigment used to develop a metallic feel, the pigment being flat or flaky and including metallic aluminum powder as a main component. The aluminum pigment may be subjected, as necessary, to surface treatment with an inorganic oxide such as silica or with a resin. Commercially available aluminum pigments can be used, and examples thereof include PCS900 (manufactured by Eckart).

From the viewpoint of metallic gloss, it is necessary that the amount of the aluminum pigment in the toner particle be in the range of from 10% by mass to 40% by mass. The content of the aluminum pigment is preferably in the range of from 15% by mass to 35% by mass.

From the viewpoint of metallic gloss, the volume average particle diameter of the aluminum pigment is preferably in the range of from 0.5 μm to 30 μm, and more preferably in the range of from 1.0 μm to 20 μm.

In the present invention, the fatty acid metal salt refers to a compound represented by the following formula (1).

$$(R\text{—}COO)_p \quad M \quad (OH)_q \tag{1}$$

In formula (1), R is each independently a linear or branched alkyl group having a carbon number of from 8 to 30 (preferably from 9 to 25), or a linear or branched hydroxyalkyl group having a carbon number of from 8 to 30 (preferably from 9 to 25) and M is Al, Zn, Mg, Ca, Sr, K or Na. p represents an integer of from 1 to 3 (preferably from 2 to 3), and q represents an integer of from 0 to 2 (preferably from 0 to 1). The metal M is preferably Al, Zn, Mg, Ca, or Sr.

The fatty acid metal salt is contained in the toner particle, and is preferably present inside the toner particle. From the viewpoint of folding resistance, it is necessary that the amount of the fatty acid metal salt in the toner particle be in the range of from 1 part by mass or more and 10 parts by mass or less based on 100 parts by mass of the aluminum pigment. Preferably this amount is in the range of from 1 part by mass to 5 parts by mass.

Where an endothermic peak area at a melting point T (° C.) of the fatty acid metal salt alone measured by a differential scanning calorimeter (DSC) using 0.01 g of the fatty acid metal salt alone is denoted by S1 (J), a peak area of a maximum endothermic peak in a temperature range of from T-10 (° C.) to T+10 (° C.) measured by a differential scanning calorimeter (DSC) using 0.01 g of the toner is denoted by S2 (J), and a mass of the fatty acid metal salt contained in 0.01 g of the toner is denoted by W (g), it is preferable that $0 \leq (S2/W)/(S1/0.01) \leq 0.5$. More preferably, $0 \leq (S2/W)/(S1/0.01) \leq 0.3$, and even more preferably 0 $(S2/W)/(S1/0.01) \leq 0.2$.

Within the above range, the ratio of the fatty acid metal salt compatible with the toner particle becomes appropriate, which is preferable from the viewpoint of folding resistance. S2 can be controlled by selecting the type of resin, adjusting production conditions (for example, kneading and cooling conditions in a pulverization method), and the like.

The specific measuring method of the differential scanning calorimeter (DSC) is as follows. As a measuring device, a differential scanning calorimeter "Q2000" manufactured by TA Instruments is used. A 0.01 g sample is precisely weighed in an aluminum pan, and the temperature is raised from 0° C. to 200° C. at a rate of 10° C./min to obtain a DSC curve.

In the measurement from the toner, the fatty acid metal salt can be separated and measured by the following method.

Separation of Fatty Acid Metal Salt from Toner

A total of 160 g of sucrose (manufactured by Kishida Chemical Co., Ltd.) is added to 100 mL of ion exchanged water and dissolved by heating with a water bath to prepare a sucrose concentrate. Then, 31 g of the sucrose concentrate and 6 mL of CONTAMINON N (10-mass % aqueous solution of neutral detergent for washing precision measuring instruments that includes a nonionic surfactant, an anionic surfactant and an organic builder and has a pH of 7; manufactured by Wako Pure Chemical Industries, Ltd.) are placed in a centrifuge tube to prepare a dispersion liquid.

A total of 1.0 g of the toner is added to the dispersion liquid and lumps of the toner are loosened with a spatula or the like. The centrifuge tube is shaken with a shaker. After shaking, the solution is transferred to a glass tube for a swing rotor (50 mL), and separation is performed under the conditions of 3500 rpm and 30 min with a centrifuge.

This operation separates the toner particle and the separated external additives. After visual confirmation that the toner and the aqueous solution have been sufficiently separated, the toner particle is collected and filtered with a vacuum filter and then dried with a dryer for 1 h or more to obtain a toner particle from which the external additive has been separated.

Further, the obtained a toner particle are dissolved with a solvent such as tetrahydrofuran, toluene, and hexane to dissolve and separate the inorganic white pigment and soluble components other than the fatty acid metal salt compound. The fatty acid metal salt compound is extracted with a heated solvent such as xylene and toluene, and the filtrate is concentrated and dried to separate the fatty acid metal salt compound.

Where the acid value of the resin having an acid group is denoted by A (mg KOH/g), the amount of the resin having an acid group that is contained in 1 g of the toner particles is denoted by a (g), and the amount of the metal M contained in the fatty acid metal salt contained in 1 g of the toner particles is denoted by b (mol), from the viewpoint of folding resistance, it is preferable that $[A \times a/(56.1 \times 1{,}000)]/b$ is in the range of from 0.10 to 0.50, more preferably in the range of from 0.20 to 0.40.

$[A \times a/(56.1 \times 1{,}000)]/b$ indicates the molar ratio between the acid group of the resin having an acid group and the metal of the fatty acid metal salt. Within the above range, the interaction between the resin having an acid group and fatty acid metal salts is adequate, and as a result, the interaction between the three substances including the aluminum pigment works effectively, so that the folding resistance is improved.

Where a detection amount of metal atoms contained in the fatty acid metal salt measured by surface analysis of the toner by X-ray photoelectron spectroscopy (ESCA) is denoted by c [atom %], and an amount of the metal M contained in the fatty acid metal salt contained in 100 g of the toner is denoted by d [mol], c and d preferably satisfy a relationship of $c/d \leq 1$, more preferably $0 \leq c/d \leq 0.5$.

Here, c/d is an index indicating the degree of presence of the fatty acid metal salt contained in the toner on the outermost surface of the toner particle. When c/d is within the above range, the fatty acid metal salt is present inside the toner particle, and as a result, the interaction between the resin having an acid group, the aluminum pigment, and the fatty acid metal salt is facilitated and the folding resistance is improved.

A specific measuring method of X-ray photoelectron spectroscopy (ESCA) is described hereinbelow. The measurement is performed using an X-ray photoelectron spectroscopy analyzer (PHI® 5000 VERSAPROBE II, manufactured by ULVAC-PHI, Inc.).

The toner is placed on a dent of a sample table, pressed and rubbed, then introduced into the chamber, and measured under the conditions of X-ray setting of 100 μm (beam diameter) of 25 W and 15 kV, Pass Energy of 58.7 eV, and Step of 0.125 eV. The measurement result is analyzed, and c [atom %] is calculated from the peak intensity of the metal contained in the fatty acid metal salt.

The toner may include a release agent. Examples of the release agent are presented hereinbelow.

Low-molecular-weight polyolefins such as polyethylene; silicones having a melting point (softening point) upon heating; fatty acid amides such as oleamide, erucamide, ricinoleamide, and stearamide; ester waxes such as stearyl stearate; vegetable waxes such as carnauba wax, rice wax, candelilla wax, wood wax, and jojoba oil; animal waxes such as beeswax; mineral and petroleum waxes such montan wax, ozokerite, ceresin, paraffin wax, microcrystalline wax, Fischer-Tropsch wax, and ester waxes; and modified products thereof.

The amount of the release agent is preferably from 1 part by mass to 25 parts by mass based on 100 parts by mass of the resin having an acid group.

The melting point of the release agent is preferably from 50° C. to 100° C., and more preferably from 70° C. to 100° C.

A known method can be used as a method for producing the toner particle. It is preferable to include a step of mixing a resin having an acid group with a fatty acid metal salt and an aluminum pigment and kneading under heating. That is, the toner particle is preferably pulverized toner particle.

Hereinafter, as an example, a procedure for producing a toner by a pulverization method will be described.

In a raw material mixing step, as a material constituting the toner particle, for example, a resin having an acid group, a fatty acid metal salt, an aluminum pigment, and if necessary, other components such as a release agent and a charge control agent are weighed to predetermined amounts, blended and mixed. The mixing apparatus can be exemplified by the double-cone mixer, V-mixer, drum mixer, Supermixer, Henschel mixer, Nauta mixer, Mechano Hybrid (Nippon Coke & Engineering Co., Ltd.), and so forth.

The mixed material is then melt-kneaded. The melt-kneading step can use a batch kneader such as a pressure kneader or a Banbury mixer or can use a continuous kneader. Single-screw and twin-screw extruders are preferable for the advantage they offer of enabling continuous production. The temperature of the melt-kneading is preferably 100° C. to 200° C.

Examples in this regard are the KTK twin-screw extruder (Kobe Steel, Ltd.), TEM twin-screw extruder (Toshiba Machine Co., Ltd.), PCM kneader (Ikegai Corp.), Twin Screw Extruder (KCK), Co-Kneader (Buss), and Kneadex (Nippon Coke & Engineering Co., Ltd.). The resin composition yielded by melt-kneading may be rolled using, for example, a two-roll mill, and may be cooled in a cooling step using, for example, water.

The cooled resin composition is then pulverized in a pulverization step to a desired particle diameter. In the pulverization step, for example, a coarse pulverization is performed using a grinder such as a crusher, hammer mill, or feather mill, followed by a fine pulverization using, for example, a pulverizer such as a Kryptron System (Kawasaki Heavy Industries, Ltd.), Super Rotor (Nisshin Engineering Inc.), or Turbo Mill (Turbo Kogyo Co., Ltd.) or using an air jet system.

The classified product (toner particle) is then obtained as necessary by carrying out classification using a sieving apparatus or a classifier, e.g., an internal classification system such as the Elbow Jet (Nittetsu Mining Co., Ltd.) or a centrifugal classification system such as the Turboplex (Hosokawa Micron Corporation), TSP Separator (Hosokawa Micron Corporation), or Faculty (Hosokawa Micron Corporation).

The obtained a toner particle may be directly used as a toner. If necessary, an external additive may be externally added to the surface of the toner particle to form a toner. As a method of externally adding an external additive, predetermined amount of a toner particle and various known external additives are blended, and stirring and mixing is performed using a mixing device such as a double-cone mixer, a V-type mixer, a drum mixer, a SUPER mixer, a Henschel mixer, a NAUTA mixer, a MECHANOHYBRID (manufactured by Nippon Coke Industry Co., Ltd.) or NOBILTA (manufactured by Hosokawa Micron Corporation) as an external addition device.

The volume-based median diameter of the toner of the present invention is preferably from 3.0 μm to 30.0 μm, and more preferably from 4.0 μm to 20.0 μm.

Hereinafter, methods for measuring physical properties related to the present invention will be described.

Measurement of Amount of Resin Having Acid Group in Toner Particles

The resin having an acid group is dissolved by a solvent such as tetrahydrofuran from a toner particle from which the external additive has been separated by the above-mentioned method, followed by filtration and extraction of the filtrate. The filtrate is concentrated and dried after centrifugation to measure the amount of the resin having an acid group.

Measurement of Amount of Aluminum Pigment in Toner Particle

The aluminum pigment and the fatty acid metal salt are separated from the toner particle from which the external additive has been separated by the above-described method, the fatty acid metal salt is extracted with a heated solvent such as xylene or toluene, and the amount of the remaining aluminum pigment is measured.

Measurement of Amount of Fatty Acid Metal Salt in Toner Particle

The fatty acid metal salt is extracted by the above-described method and the amount thereof is measured. The structure of the fatty acid metal salt in the residual fraction is determined using nuclear magnetic resonance spectroscopy (NMR), infrared spectroscopy (IR), and X-ray fluorescence measurement.

Measurement of Amount of Metal M in Fatty Acid Metal Salt in Toner Particle

After the fatty acid metal salt has been extracted by the above-described method, the amount is quantified by X-ray fluorescence measurement or ICP emission analysis.

Measurement of Number Average Molecular Weight (Mn) and Weight Average Molecular Weight (Mw) of Resin Having Acid Group The number average molecular weight (Mn) and weight average molecular weight (Mw) are measured by gel permeation chromatography (GPC) in the following manner.

First, the sample (resin) is dissolved in tetrahydrofuran (THF) at room temperature over 24 h. Then, the obtained solution is filtered through a solvent-resistant membrane filter "MAESHORI DISK" (manufactured by Tosoh Corporation) having a pore diameter of 0.2 μm to obtain a sample solution. The sample solution is adjusted so that the concentration of the component soluble in THF is about 0.8% by mass. Using this sample solution, measurement is performed under the following conditions.

Device: HLC8120 GPC (detector: RI) (manufactured by Tosoh Corporation)

Column: seven columns of Shodex KF-801, 802, 803, 804, 805, 806, and 807 (manufactured by Showa Denko K.K.)

Eluent: tetrahydrofuran (THF)

Flow rate: 1.0 ml/min

Oven temperature: 40.0° C.

Sample injection volume: 0.10 ml

In calculating the molecular weight of the sample, a molecular weight calibration curve created using standard polystyrene resins (for example, trade name "TSK Standard Polystyrene F-850, F-450, F-288, F-128, F-80, F-40, F-20, F-10, F-4, F-2, F-1, A-5000, A-2500, A-1000, and A-500", manufactured by Tosoh Corporation) is used.

Method for Measuring Acid Value

The acid value is the number of milligrams of potassium hydroxide required to neutralize the acid contained in 1 g of the sample. The acid value of a material such as a resin having an acid group is measured according to JIS K 0070-1992, and specifically, it is measured according to the following procedure.

(1) Preparation of Reagent

A total of 1.0 g of phenolphthalein is dissolved in 90 ml of ethyl alcohol (95% by volume), and ion-exchanged water is added to make 100 ml to obtain a phenolphthalein solution.

A total of 7 g of special grade potassium hydroxide is dissolved in 5 ml of water and ethyl alcohol (95% by volume) is added to make 1 L. The solution is placed alkali-resistant container and allowed to stand for 3 days so as not to be exposed to carbon dioxide gas and then filtered to obtain a potassium hydroxide solution. The obtained potassium hydroxide solution is stored in an alkali-resistant container. A total of 25 ml of 0.1 mol/1 hydrochloric acid is placed in an Erlenmeyer flask, a few drops of the phenolphthalein solution are added, titration is performed with the potassium hydroxide solution, and the factor of the potassium hydroxide solution is determined from the amount of the potassium hydroxide solution required for neutralization. The 0.1 mol/1 hydrochloric acid produced according to JIS K 8001-1998 is used.

(2) Operation (A) Main Test

A total of 2.0 g of a sample is precisely weighed in a 200 ml Erlenmeyer flask, and 100 ml of a mixed solution of toluene/ethanol (2:1) is added to dissolve the sample for 5 hours. Next, several drops of the phenolphthalein solution are added as an indicator, and titration is performed using the potassium hydroxide solution. The end point of the titration is when the light red color of the indicator continues for about 30 sec.

(B) Blank Test

The same titration as in the above procedure is performed except that no sample is used (that is, only a mixed solution of toluene/ethanol (2:1) is used). (3) The obtained result is substituted into the following equation to calculate the acid value.

$$A=[(C-B)\times f\times 5.61]/S$$

Here, A: acid value (mg KOH/g), B: addition amount (ml) of potassium hydroxide solution in blank test, C: addition amount (ml) of potassium hydroxide solution in main test, f: potassium hydroxide solution factor, S: mass (g) of sample.

When Measuring from Toner

The resin having an acid group is dissolved by a solvent such as tetrahydrofuran from a toner particle from which the external additive has been separated by the above-mentioned method, followed by filtration and extraction of the filtrate. The filtrate is concentrated and dried after centrifugation, and the acid value of the obtained resin having an acid group is measured.

Measurement of Content Ratio of Components Having Molecular Weight in the Range of from 100 to 5,000 as Measured by GPC of the THF-Soluble Fraction of Resin Having Acid Group.

The integrated concentration of the molecular weight in the range of from 100 to 5,000 is determined from the integrated molecular weight distribution curve obtained by the GPC measurement, and the content ratio is calculated.

EXAMPLES

Hereinafter, the present invention will be described in greater detail with reference to Examples and Comparative Examples, but embodiments of the present invention are not limited thereto. Unless otherwise specified, all parts and percentages in Examples and Comparative Examples are based on mass. Table 1 shows the constituent conditions of each toner particle.

Example 1

Polyester resin 1: 64 parts

[Composition (mol %)] [polyoxypropylene (2.2)-2,2-bis(4-hydroxyphenyl)propane:polyoxyethylene (2.2)-2,2-bis(4-hydroxyphenyl) propane:terephthalic acid:dodecylsuccinic acid:trimellitic acid=80:20:75:10:15], Mw=152,000, Mw/Mn=32, the amount of component having a molecular weight in the range of from 100 to 5,000=25% by mass, and the acid value=12 mg KOH/g]

Aluminum pigment (PCS900, silica-treated metal aluminum pigment, manufactured by Eckart): 30 parts Fisher-Tropsch wax (melting point 78° C.): 5 parts Calcium distearate: 1 part

[In formula (1), R=$C_{17}H_{35}$, M=Ca, p=2, q=0]

The above materials were mixed using a Henschel mixer (model FM-75, manufactured by Mitsui Mining Co., Ltd.) at a rotation speed of 20 $s^{-1}$ and a rotation time of 5 min, and then kneaded with a twin-screw kneader (PCM-30, manufactured by Ikegai Co., Ltd.) set to a temperature of 130° C.

The obtained kneaded material was cooled to 25° C. and coarsely pulverized to 1 mm or less by a hammer mill to obtain a coarsely pulverized material. The obtained coarsely pulverized material was finely pulverized with a mechanical pulverizer (T-250, manufactured by Turbo Kogyo KK). Classification was further performed using FACULTY F-300 (manufactured by Hosokawa Micron Corporation) to obtain a toner particle 1.

A total of 1.5 parts of hydrophobically treated silica fine powder having a primary particle diameter of 10 nm and 2.5 parts of hydrophobically treated silica fine powder having a primary particle diameter of 100 nm per 100 parts of the obtained a toner particle 1 were dry-mixed with a Henschel mixer (manufactured by Mitsui Mining Co., Ltd.) to obtain a toner 1. The volume-based median diameter of the toner 1 was 9.3 μm.

Example 2

A toner 2 was obtained in the same manner as in Example 1, except that the amount of the polyester resin 1 was changed to 84 parts and the amount of the aluminum pigment was changed to 10 parts. The volume-based median diameter of the toner 2 was 9.3 μm.

Example 3

A toner 3 was obtained in the same manner as in Example 1, except that the amount of polyester resin 1 was changed to 54 parts and the amount of the aluminum pigment was changed to 40 parts. The volume-based median diameter of the toner 3 was 9.5 μm.

Example 4

A toner 4 was obtained in the same manner as in Example 1, except that the polyester resin 1 was replaced with a polyester resin 2 [composition (mol %) [polyoxypropylene (2.2)-2,2-bis(4-hydroxyphenyl)propane:polyoxyethylene (2.2)-2,2-bis (4-hydroxyphenyl)propane:fumaric acid:trimellitic acid=72:28:90:10], Mw=91,000, Mw/Mn=25, the amount of component having a molecular weight in the range of from 100 to 5,000=31% by mass, and the acid value=7 mg KOH/g]. The volume-based median diameter of the toner 4 was 9.0 μm.

Example 5

A toner 5 was obtained in the same manner as in Example 1, except that the polyester resin 1 was replaced with a polyester resin 3 [composition (mol %) [polyoxypropylene (2.2)-2,2-bis(4-hydroxyphenyl)propane:polyoxyethylene (2.2)-2,2-bis(4-hydroxyphenyl)propane:fumaric acid:dodecylsuccinic acid:trimellitic acid=77:23:65:5:30], Mw=121,000, Mw/Mn=35, the amount of component having a molecular weight in the range of from 100 to 5,000=32% by mass, and the acid value=21 mg KOH/g]. The volume-based median diameter of the toner 5 was 9.3 μm.

Example 6

A toner 6 was obtained in the same manner as in Example 1, except that the amount of the polyester resin 1 was changed to 64.5 parts and the amount of calcium distearate was changed to 0.5 part. The volume-based median diameter of the toner 6 was 9.2 μm.

Example 7

A toner 7 was obtained in the same manner as in Example 1, except that the amount of the polyester resin 1 was changed to 63 parts and the amount of the calcium distearate was changed to 2 parts. The volume-based median diameter of the toner 7 was 9.1 μm.

Example 8

A toner 8 was obtained in the same manner as in Example 1, except that calcium distearate was replaced with aluminum tristearate [in formula (1), R=$C_{17}H_{35}$, M=Al, p=3, q=0]. The volume-based median diameter of the toner 8 was 9.3 μm.

According to the method described hereinabove, the silica fine powder and the polyester resin were removed from the toner 8, the aluminum tristearate was further extracted using xylene heated to 110° C., and after drying, the aluminum tristearate was quantified by fluorescent X-ray measurement.

The remaining aluminum pigment was dried and the mass thereof was measured. The amount of the aluminum pigment in the toner particle obtained by the above method was 30% by mass, and the amount of aluminum tristearate relative to the aluminum pigment was 3.3% by mass.

Example 9

A toner 9 was obtained in the same manner as in Example 1, except that calcium distearate was replaced with sodium stearate [in formula (1), R=$C_{17}H_{35}$, M=Na, p=1, q=0], and the temperature of the twin-screw kneader was changed to 180° C. The volume-based median diameter of the toner 9 was 9.4 μm.

Example 10

A toner 10 was obtained in the same manner as in Example 1, except that calcium distearate was replaced with calcium 12-hydroxydistearate [in formula (1), R=$C_6H_{13}$—CH(OH)—$C_{10}H_{20}$, M=Ca, p=2, q=0], and the temperature of the twin-screw kneader was changed to 160° C. The volume-based median diameter of the toner 10 was 8.9 μm.

Example 11

A toner 11 was obtained in the same manner as in Example 1, except that calcium distearate was replaced with calcium behenate [in formula (1), R=$C_{21}H_{43}$, M=Ca, p=2, q=0], and the temperature of the twin-screw kneader was changed to 140° C. The volume-based median diameter of the toner 11 was 9.3 μm.

Example 12

A toner 12 was obtained in the same manner as in Example 1, except that calcium distearate was replaced with calcium decanoate [in formula (1), R=$C_9H_{19}$, M=Ca, p=2, q=0]. The volume-based median diameter of the toner 12 was 9.1 μm.

Example 13

A toner 13 was obtained in the same manner as in Example 1, except that the polyester resin 1 was replaced with a polyester resin 4 [composition (mol %) [polyoxypropylene (2.2)-2,2-bis(4-hydroxyphenyl)propane:polyoxyethylene (2.2)-2,2-bis(4-hydroxyphenyl)propane:fumaric acid: trimellitic acid=55:45:85:15], Mw=132,000, Mw/Mn=36, the amount of component having a molecular weight in the range of from 100 to 5,000=33% by mass, and the acid value=11 mg KOH/g]. The volume-based median diameter of the toner 13 was 9.2 μm.

Example 14

A toner 14 was obtained in the same manner as in Example 1, except that the polyester resin 1 was replaced with a polyester resin 5 [composition (mol %) [polyoxypropylene (2.2)-2,2-bis(4-hydroxyphenyl)propane:polyoxyethylene (2.2)-2,2-bis(4-hydroxyphenyl)propane:fumaric acid: trimellitic acid=74:26:95:5], Mw=52,000, Mw/Mn=12, the amount of component having a molecular weight in the range of from 100 to 5,000=29 mass %, the acid value=14 mg KOH/g]. The volume-based median diameter of the toner 14 was 9.2 μm.

Example 15

A toner 15 was obtained in the same manner as in Example 1, except that the polyester resin 1 was replaced with a polyester resin 6 [composition (mol %) [polyoxypropylene (2.2)-2,2-bis(4-hydroxyphenyl)propane:polyoxyethylene (2.2)-2,2-bis(4-hydroxyphenyl)propane:terephthalic acid:fumaric acid:trimellitic acid=80:20:35:55:10], Mw=110,000, Mw/Mn=11, the amount of component having a molecular weight in the range of from 100 to 5,000=18% by mass, and the acid value=15 mg KOH/g]. The volume-based median diameter of the toner 15 was 9.0 μm.

Example 16

A toner 16 was obtained in the same manner as in Example 1 except that the temperature of the twin-screw kneader was changed to 100° C. The volume-based median diameter of the toner 16 was 9.3 μm.

Example 17

A toner 17 was obtained in the same manner as in Example 1, except that the amount of the polyester resin 1 was changed to 64.6 parts and the amount of calcium distearate was changed to 0.4 parts. The volume-based median diameter of the toner 17 was 9.3 μm.

Example 18

A toner 18 was obtained in the same manner as in Example 1, except that the amount of the polyester resin 1 was changed to 61.5 parts and the amount of calcium distearate was changed to 3.5 parts. The volume-based median diameter of the toner 18 was 9.1 μm.

Example 19

A toner 19 was obtained in the same manner as in Example 1, except that the calcium distearate was replaced with zinc distearate [in formula (1), R=$C_{17}H_{35}$, M=Zn, p=2, q=0]. The volume-based median diameter of the toner 19 was 9.2 μm.

Example 20

A toner 20 was obtained in the same manner as in Example 1, except that the polyester resin 1 was replaced with a styrene acrylic resin S1 [composition (mol %) styrene:n-butyl acrylate:acrylic acid=76:22:2], Mw=51,000, Mw/Mn=3, the amount of component having a molecular weight in the range of from 100 to 5,000=10% by mass, and the acid value=9 mg KOH/g]. The volume-based median diameter of the toner 20 was 9.4 μm.

Comparative Example 1

A toner 21 was obtained in the same manner as in Example 1, except that the amount of the polyester resin 1 was changed to 89.8 parts, the amount of the aluminum pigment was changed to 5 parts, and the amount of calcium distearate was changed to 0.2 parts. The volume-based median diameter of the toner 21 was 9.0 μm.

Comparative Example 2

A toner 22 was obtained in the same manner as in Example 1, except that the amount of the polyester resin 1 was changed to 44 parts, the amount of the aluminum pigment was changed to 50 parts, and the amount of calcium distearate was changed to 1 part. The volume-based median diameter of the toner 22 was 9.6 μm.

Comparative Example 3

A toner 23 was obtained in the same manner as in Example 1, except that the amount of the polyester resin 1 was changed to 64.8 parts and the amount of calcium distearate was changed to 0.2 parts. The volume-based median diameter of the toner 23 was 9.1 μm.

Comparative Example 4

A toner 24 was obtained in the same manner as in Example 1, except that the amount of the polyester resin 1 was changed to 60 parts and the amount of calcium distearate was changed to 5 parts. The volume-based median diameter of the toner 24 was 9.4 μm.

Comparative Example 5

A toner 25 was obtained in the same manner as in Example 1, except that the polyester resin 1 was replaced with a polyester resin 7 [composition (mol %) [polyoxypropylene (2.2)-2,2-bis (4-hydroxyphenyl)propane:terephthalic acid:trimellitic acid=100:90:10], Mw=185,000, Mw/Mn=36, the amount of component having a molecular weight in the range of from 100 to 5,000=27% by mass, and the acid value=3 mg KOH/g]. The volume-based median diameter of the toner 25 was 9.2 μm.

Comparative Example 6

A toner 26 was obtained in the same manner as in Example 1, except that the polyester resin 1 was replaced with a polyester resin 8 [composition (mol %) [polyoxypropylene (2.2)-2,2-bis(4-hydroxyphenyl)propane:polyoxyethylene (2.2)-2,2-bis (4-hydroxyphenyl)propane:fumaric acid: trimellitic acid=75:25:80:20], Mw=154,000, Mw/Mn=39, the amount of component having a molecular weight in the range of from 100 to 5,000=28% by mass, and the acid value=27 mg KOH/g]. The volume-based median diameter of the toner 26 was 9.0 μm.

Comparative Example 7

A toner 27 was obtained in the same manner as in Example 1, except that calcium distearate was replaced with calcium benzoate. The volume-based median diameter of the toner 27 was 9.2 μm.

Comparative Example 8

A toner 28 was obtained in the same manner as in Example 1, except that calcium distearate was replaced with calcium propionate. The volume-based median diameter of the toner 28 was 9.3 μm.

Comparative Example 9

Toner particles 27 were obtained in the same manner as in Example 1, except that the amount of the polyester resin 1 was changed to 65 parts and the amount of calcium distearate was changed to 0 parts.

A toner 29 was obtained by dry mixing 1.5 of a hydrophobicized silica fine powder having a primary particle diameter of 10 nm, 2.5 parts of a hydrophobicized silica fine powder having a primary particle diameter of 100 nm, and 1 part of calcium stearate with 100 parts of the obtained toner particles with a Henschel mixer (Mitsui Mining Co.). The volume-based median diameter of the toner 29 was 10.1 μm.

The following evaluation tests were performed using the above toners. Table 1 shows the evaluation results.

Metallic Gloss

The above toners and a ferrite carrier (average particle diameter: 42 μm) surface-coated with a silicone resin were mixed so that the toner concentration became 8% by mass to prepare a two-component developer. An unfixed toner image (0.9 mg/cm$^2$) was formed on coated paper (OK Topcoat+, manufactured by Oji Paper Co., Ltd., 127 g/m$^2$) using a commercially available full-color digital copying machine (CLC1100, manufactured by Canon Inc.).

A fixing unit removed from a commercially available full-color digital copying machine (imageRUNNER ADVANCE C5051, manufactured by Canon Inc.) was modified so that the fixing temperature could be adjusted, a process speed was set to 357 mm/sec at a room temperature of 15° C. and a humidity of 10%, and the unfixed image was fixed. The specular reflectance of the image of the fixed material at the highest temperature at which fixing was possible was measured with a variable angle photometer GH-100S (incident angle: 45°, light receiving angle: 315°) manufactured by Asahi Bunko Co., Ltd., and the gloss was evaluated in combination with visual observation.

Evaluation Criteria

A: The specular reflectance is 1% or more, and the metallic gloss is visually high.

B: The specular reflectance is 0.5% or more and less than 1%, and the metallic gloss is visually observed.

C: The specular reflectance is less than 0.5%, and almost no metallic gloss is visually observed.

Folding Resistance

An unfixed toner image (0.9 mg/cm') was formed on an image receiving paper (64 g/m$^2$) by using the two-component developers obtained above and a commercially available full-color digital copying machine (CLC1100, manufactured by Canon Inc.). A fixing unit removed from a commercially available full-color digital copying machine (imageRUNNER ADVANCE C5051, manufactured by Canon Inc.) was modified so that the fixing temperature could be adjusted, a process speed was set to 357 mm/sec at a room temperature of 15° C. and a humidity of 10%, and the unfixed image was fixed.

The fixed image at the highest fixing temperature was bent crosswise and rubbed five times back and forth with soft thin paper (trade name "Dusper", manufactured by Ozu Corp.) while applying a load of 4.9 kPa. Next, a 512-pixel square region of the cross portion was captured with a CCD camera at a resolution of 800 pixels/inch. The threshold was set to 60%, the image was binarized, and the area ratio of a white portion where the toner was peeled off was measured. The smaller the area ratio of the white portion, the better the bending resistance.

Evaluation Criteria

A: area ratio of white portion is less than 2.0%

B: area ratio of white portion is 2.0% or more and less than 4.0%

C: area ratio of white portion is 4.0% or more and less than 6.0%

D: area ratio of white portion is 6.0% or more

TABLE 1

| | | Resin having an acid group | | | | | | | | | |
|---|---|---|---|---|---|---|---|---|---|---|---|
| | | | | | | | Low-molecular-weight component | PO | Aluminum pigment | Fatty acid metal salt | |
| Example No. | Toner No. | No. | Amount % by mass | Acid value | Mw | Mw/Mn | amount % by mass | ratio mol % | Amount % by mass | | Amount % by mass |
| 1 | 1 | 1 | 64 | 12 | 152000 | 32 | 25 | 80 | 30 | Ca distearate | 3.3 |
| 2 | 2 | 1 | 84 | 12 | 152000 | 32 | 25 | 80 | 10 | Ca distearate | 10.0 |
| 3 | 3 | 1 | 54 | 12 | 152000 | 32 | 25 | 80 | 40 | Ca distearate | 2.5 |
| 4 | 4 | 2 | 64 | 7 | 91000 | 25 | 31 | 72 | 30 | Ca distearate | 3.3 |
| 5 | 5 | 3 | 64 | 21 | 121000 | 35 | 32 | 77 | 30 | Ca distearate | 3.3 |
| 6 | 6 | 1 | 64.5 | 12 | 152000 | 32 | 25 | 80 | 30 | Ca distearate | 1.7 |
| 7 | 7 | 1 | 63 | 12 | 152000 | 32 | 25 | 80 | 30 | Ca distearate | 6.7 |
| 8 | 8 | 1 | 64 | 12 | 152000 | 32 | 25 | 80 | 30 | Al tristearate | 3.3 |
| 9 | 9 | 1 | 64 | 12 | 152000 | 32 | 25 | 80 | 30 | Na stearate | 3.3 |
| 10 | 10 | 1 | 64 | 12 | 152000 | 32 | 25 | 80 | 30 | Ca hydroxystearate | 3.3 |
| 11 | 11 | 1 | 64 | 12 | 152000 | 32 | 25 | 80 | 30 | Ca behenate | 3.3 |
| 12 | 12 | 1 | 64 | 12 | 152000 | 32 | 25 | 80 | 30 | Ca decanoate | 3.3 |
| 13 | 13 | 4 | 64 | 11 | 132000 | 36 | 33 | 55 | 30 | Ca distearate | 3.3 |

TABLE 1-continued

| | | | | | | | | | | | |
|---|---|---|---|---|---|---|---|---|---|---|---|
| 14 | 14 | 5 | 64 | 14 | 52000 | 12 | 29 | 74 | 30 | Ca distearate | 3.3 |
| 15 | 15 | 6 | 64 | 15 | 110000 | 11 | 18 | 80 | 30 | Ca distearate | 3.3 |
| 16 | 16 | 1 | 64 | 12 | 152000 | 32 | 25 | 80 | 30 | Ca distearate | 3.3 |
| 17 | 17 | 1 | 64.6 | 12 | 152000 | 32 | 25 | 80 | 30 | Ca distearate | 1.3 |
| 18 | 18 | 1 | 61.5 | 12 | 152000 | 32 | 25 | 80 | 30 | Ca distearate | 11.7 |
| 19 | 19 | 1 | 64 | 12 | 152000 | 32 | 25 | 80 | 30 | Zn distearate | 3.3 |
| 20 | 20 | S1 | 64 | 9 | 51000 | 3 | 10 | | 30 | Ca distearate | 3.3 |
| Comp.1 | 21 | 1 | 89.8 | 12 | 152000 | 32 | 25 | 80 | 5 | Ca distearate | 4.0 |
| Comp.2 | 22 | 1 | 44 | 12 | 152000 | 32 | 25 | 80 | 50 | Ca distearate | 2.0 |
| Comp.3 | 23 | 1 | 64.8 | 12 | 152000 | 32 | 25 | 80 | 30 | Ca distearate | 0.7 |
| Comp.4 | 24 | 1 | 60 | 12 | 152000 | 32 | 25 | 80 | 30 | Ca distearate | 16.7 |
| Comp.5 | 25 | 7 | 64 | 3 | 185000 | 36 | 27 | 100 | 30 | Ca distearate | 3.3 |
| Comp.6 | 26 | 8 | 64 | 27 | 154000 | 39 | 28 | 75 | 30 | Ca distearate | 3.3 |
| Comp.7 | 27 | 1 | 64 | 12 | 152000 | 32 | 25 | 80 | 30 | Ca benzoate | 3.3 |
| Comp.8 | 28 | 1 | 64 | 12 | 152000 | 32 | 25 | 80 | 30 | Ca propionate | 3.3 |
| Comp.9 | 29 | 1 | 65 | 12 | 152000 | 32 | 25 | 80 | 30 | Ca distearate | 0.0 |

| Example No. | Toner No. | A | B | C | Metallic gloss | Folding resistance |
|---|---|---|---|---|---|---|
| 1 | 1 | 0.21 | 0.0 | 0 | A | A |
| 2 | 2 | 0.27 | 0.0 | 0 | B | A |
| 3 | 3 | 0.18 | 0.0 | 0 | A | B |
| 4 | 4 | 0.12 | 0.0 | 0 | A | B |
| 5 | 5 | 0.36 | 0.0 | 0 | A | B |
| 6 | 6 | 0.42 | 0.0 | 0 | A | B |
| 7 | 7 | 0.10 | 0.1 | 0 | B | B |
| 8 | 8 | 0.44 | 0.0 | 0 | A | B |
| 9 | 9 | 0.18 | 0.3 | 0 | A | C |
| 10 | 10 | 0.22 | 0.0 | 0 | A | A |
| 11 | 11 | 0.24 | 0.0 | 0 | A | A |
| 12 | 12 | 0.13 | 0.0 | 0 | A | B |
| 13 | 13 | 0.19 | 0.1 | 0 | A | C |
| 14 | 14 | 0.24 | 0.0 | 0 | A | B |
| 15 | 15 | 0.26 | 0.0 | 0 | B | C |
| 16 | 16 | 0.21 | 0.5 | 0 | A | C |
| 17 | 17 | 0.52 | 0.0 | 0 | A | C |
| 18 | 18 | 0.06 | 0.3 | 0 | B | C |
| 19 | 19 | 0.13 | 0.0 | 0 | A | B |
| 20 | 20 | 0.16 | 0.0 | 0 | A | C |
| Comp.1 | 21 | 1.48 | 0.0 | 0 | C | A |
| Comp.2 | 22 | 0.14 | 0.0 | 0 | B | D |
| Comp.3 | 23 | 1.07 | 0.0 | 0 | A | D |
| Comp.4 | 24 | 0.04 | 0.4 | 0 | C | C |
| Comp.5 | 25 | 0.05 | 0.0 | 0 | A | D |
| Comp.6 | 26 | 0.47 | 0.0 | 0 | A | D |
| Comp.7 | 27 | 0.10 | — | 0 | B | D |
| Comp.8 | 28 | 0.00 | — | 0 | B | D |
| Comp.9 | 29 | 0.00 | 1.0 | 15 | A | D |

In the table, A is the value of "[A×a/(56.1×1,000)]/b", B is "(S2/W)/(S1/0.01)", and C is the value of c/d. The amount of the resin having an acid group and the aluminum pigment is the amount in the toner particles, and the amount of the fatty acid metal salt indicates the number of parts by mass based on 100 parts by mass of the aluminum pigment. The "PO ratio" indicates a content ratio of a monomer unit derived from a propylene oxide adduct of bisphenol A among monomer units derived from the alcohol component. The "Low-molecular-weight component amount" indicates a content ratio of a component having a molecular weight in the range of from 100 to 5,000 as measured by GPC of a THF-soluble fraction of the polyester resin. The unit of the acid value is mg KOH/g.

According to the present invention, it is possible to provide a toner having excellent metallic gloss and folding resistance of an image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. A toner, comprising:

a toner particle containing a resin having an acid group, an aluminum pigment and a fatty acid metal salt;

an acid value of the resin is 5 to 25 mg KOH/g, and the resin is contained in the toner particle at 50% by mass or more;

the aluminum pigment is contained in the toner particle at 10 to 40% by mass; and the fatty acid metal salt is contained in the toner particle at 1 to 10 parts by mass based on 100 parts by mass of the aluminum pigment, and is represented by formula (1)

$$(R—COO)_p \quad M \quad (OH)_q \tag{1}$$

where R is independently a linear or branched alkyl group having a carbon number from 8 to 30, or a linear or branched hydroxyalkyl group having a carbon number from 8 to 30, M is Al, Zn, Mg, Ca, Sr, K or Na, p is an integer of 1 to 3, and q is an integer of 0 to 2, wherein (S2/W)/(S1/0.01)=0 when T (° C.) is a melting point of the fatty acid metal salt, S1 (J) is an endothermic peak area at T (° C.) of the fatty acid metal salt alone, S2 (J) is a peak area of a maximum endothermic peak area in a temperature range of from T-10 to T+10 (° C.) measured by a differential scanning calorimeter (DSC) using 0.01 g of the toner, and W (g) is a mass of the fatty acid metal salt contained in 0.01 g of the toner.

2. The toner according to claim 1, wherein [A×a/(56.1×1,000)]/b is 0.10 to 0.50 where A (mg KOH/g) is the acid value of the resin, a (g) is the amount of the resin contained in 1 g of the toner particle, and b (mol) is the amount of metal M contained in the fatty acid metal salt contained in 1 g of the toner particle.

3. The toner according to claim 1, wherein the metal M is Al or Sr.

4. The toner according to claim 1, wherein the resin is a polyester resin.

5. The toner according to claim 4, wherein the polyester resin contains a monomer unit derived from an alkylene oxide adduct of bisphenol A.

6. The toner according to claim 5, wherein a content ratio of the monomer unit derived from an alkylene adduct of bisphenol A among monomer units derived from an alcohol component contained in the polyester resin is 70 to 100 mol %.

7. The toner according to claim 4, wherein the polyester resin has a weight average molecular weight Mw of 50,000 to 500,000, and a ratio of the weight average molecular weight Mw to a number average molecular weight Mn (Mw/Mn) of the polyester resin is 20 or more.

8. The toner according to claim 4, wherein a content ratio of a component having a molecular weight in a range of 100 to 5,000 as measured by gel permeation chromatography of a tetrahydrofuran-soluble fraction of the polyester resin is 20% by mass or more based on a total mass of the tetrahydrofuran-soluble fraction of the polyester resin.

9. The toner according to claim 1, wherein c/d≤1 where c (atom %) is a detection amount of metal atoms contained in the fatty acid metal salt measured by surface analysis of the toner by X-ray photoelectron spectroscopy (ESCA), and d (mol) is an amount of metal M contained in the fatty acid metal salt contained in 100 g of the toner.

10. The toner according to claim 1, wherein the toner particle is a pulverized toner particle.

11. A toner, comprising:

a toner particle containing a resin having an acid group, an aluminum pigment and a fatty acid metal salt;

an acid value of the resin is 5 to 25 mg KOH/g, and the resin is contained in the toner particle at 50% by mass or more;

the aluminum pigment is contained in the toner particle at 10 to 40% by mass; and the fatty acid metal salt is contained in the toner particle at 1 to 11.7 parts by mass based on 100 parts by mass of the aluminum pigment, wherein the fatty acid metal salt is represented by formula (1)

$$(R—COO)_p \quad M \quad (OH)_q \tag{1}$$

where R is independently a linear or branched alkyl group having a carbon number from 8 to 30, or a linear or branched hydroxyalkyl group having a carbon number from 8 to 30, M is Al, Zn, Mg, Ca, Sr, K or Na, p is an integer of 1 to 3, and q is an integer of 0 to 2, and (S2/W)/(S1/0.01)=0 when T (° C.) is a melting point of the fatty acid metal salt, S1 (J) is an endothermic peak area at T (° C.) of the fatty acid metal salt alone, S2 (J) is a peak area of a maximum endothermic peak area in a temperature range of from T-10 to T+10 (° C.) measured by a differential scanning calorimeter (DSC) using 0.01 g of the toner, and W (g) is a mass of the fatty acid metal salt contained in 0.01 g of the toner.

12. The toner according to claim 1, wherein the metal M is Al, Zn, Mg, Ca or Sr.

13. The toner according to claim 1, wherein the metal M is Al.

14. The toner according to claim 1, wherein the toner particle contains a release agent, and the release agent is contained at 1 to 25 parts by mass based on 100 part by mass of the resin having an acid group.

15. The toner according to claim 13, wherein the release agent has a melting point of 50 to 100° C.

* * * * *